United States Patent [19]

Kojima et al.

[11] Patent Number: 4,498,509

[45] Date of Patent: Feb. 12, 1985

[54] FILLING METHOD OF PARTICULATE MATERIAL INTO VALVED PACKING BAG AND APPARATUS EMPLOYED THEREFOR

[75] Inventors: Katsuhiko Kojima, Shiga; Toyomi Tanaka, Miyakoshi; Shigeo Nakajima, Mukoh, all of Japan

[73] Assignee: Nakajima Seisakusho Co., Ltd., Japan

[21] Appl. No.: 464,464

[22] Filed: Feb. 7, 1983

[30] Foreign Application Priority Data

Feb. 16, 1982 [JP] Japan ..... 57-23799

[51] Int. Cl.[3] ..... B65B 1/04; B65B 1/10

[52] U.S. Cl. ..... 141/10; 141/268; 141/284; 137/846; 222/505; 222/533; 383/44

[58] Field of Search ..... 141/10, 67, 68, 114, 141/313–317, 250–284; 239/587; 222/505, 533; 137/846; 383/42–58; 150/55

[56] References Cited

U.S. PATENT DOCUMENTS 3,722,755 3/1973 Nakashima ..... 222/193
3,995,408 12/1976 Guenther et al. ..... 53/126
4,003,188 1/1977 Lau ..... 141/68
4,156,503 5/1979 Norén ..... 239/587
4,398,576 8/1983 Vredenburg ..... 141/68

FOREIGN PATENT DOCUMENTS 283610 10/1952 France .

*Primary Examiner*—Houston S. Bell, Jr.
*Attorney, Agent, or Firm*—Brumbaugh, Graves, Donohue & Raymond

[57] ABSTRACT

In the particular filling method disclosed in the specification a side valve type packaging bag is filled by inserting a filling tube into the bag valve, expanding a rubber tube surrounding the filling tube to form a seal with the valve opening, supplying particulate material to the interior of the bag and rotating the filling tube to distribute the particulate material within the bag, and then wetting an adhesive in the valve before withdrawing the filling tube from the bag. The filling apparatus according to the invention includes a filling tube which is mounted for rotation about its axis on a support plate and has a pouring spout directed at an angle to its axis and a pneumatic piston connected to the filling tube to rotate the tube about its axis and weighing mechanism for detecting filling of the bag.

2 Claims, 5 Drawing Figures

FILLING METHOD OF PARTICULATE MATERIAL INTO VALVED PACKING BAG AND APPARATUS EMPLOYED THEREFOR

BACKGROUND OF THE INVENTION

The present invention generally relates to handling of materials in the form of powder or particles (referred to as particulate materials hereinbelow), and more particularly, to a method of filling a particulate material into a valved packaging bag, especially, a side valve type valved packing bag in a particulate material filling arrangement without any damage to the bag, and an apparatus employed therefor.

DESCRIPTION OF THE PRIOR ART

Commonly, for valved packaging bags, there have been employed such bags that, when the bag is set on a particulate material filling apparatus, with a filling tube of said apparatus being inserted into a valve opening or valve hole of said bag, and has been filled with a predetermined amount of the particulate material, said bag is caused to drop by a handling mechanism, at which time, the filled particulate material moves within the bag so as to be pushed out into the valve portion for automatic closing of said valve hole from inside the bag or for simultaneous sealing thereof through application of paste, etc.

However, the valved packaging bag (2) of this kind provided with gusset portions (1) as shown in FIG. 1, is generally of the side valve type in which the valve hole (3) is provided at one side with respect to folding lines (1') for the gusset portion (1), and during setting of the bag onto the filling apparatus, when the gusset portions are stretched by sucking cups or the like of the handling mechanism to open the valve hole for insertion of the filling tube thereinto, a pouring port provided at the lower half of the forward end of the filling tube, is located in such a position that its particulate material pouring axis is parallel to a plane deviated from the plane connecting the folding lines for the gusset portions, i.e. a position offset to a certain extent. In the conventional practice, since the filling has been effected in the above position as it is, the particulate material is not uniformly filled upwardly from the bottom of the bag, but is one-sided, or in other words, the level of the particulate material filled into the bag in a direction at right angles with respect to the filling tube does not become horizontal, but shows a considerably inclined state, thus causing a deviation of the center of gravity as the filling proceeds, with a moment being applied to the bag causing an undesirable twisting of the bag, with the result that the bag cannot be sufficiently supported at its bottom alone and considerable tension is applied to the valve hole in which the filling tube has been inserted. As a result, there have been such problems that, the filling tube is not only subjected to a bending moment, but the bags are sometimes broken in the course of filling of the particulate material, and therefore, some countermeasures for completely eliminating damages to the bags during the filling has been strongly required.

SUMMARY OF THE INVENTION

Accordingly, it is an essential object of the present invention to provide a method of filling a particulate material approximately uniformly in a packaging bag, and an apparatus employed therefor, which is so arranged that, during filling of a particulate material into the side valve type valved packaging bag, having a filling hole at its side portion, with a filling tube of the particulate material filling apparatus being inserted into a valve hole of said bag, the filling tube in the filling operation is adapted to rotate or pivot through a predetermined angle so that the particulate material pouring axis of its pouring port, i.e. the discharging direction of the particulate material crosses a central plane toward the opposite side of the bag, from the side of said packaging bag provided with the filling hole, whereby, through simultaneous feeding-in of the particulate material and rotation of the filling tube, the particulate material may be approximately uniformly filled into the bag.

DETAILED DESCRIPTION OF PREFERRED EMBODIMENTS OF THE INVENTION

Figure 1:
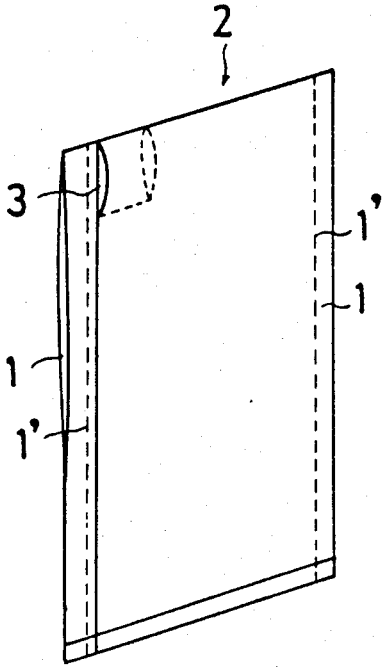
FIG. 1 is a perspective view of a packaging bag of a side valve type having gusset portions.

Referring now to the drawings, a filling method of a particulate material according to the present invention will be described in detail hereinbelow, with respect to one preferred embodiment thereof.

Figure 2:
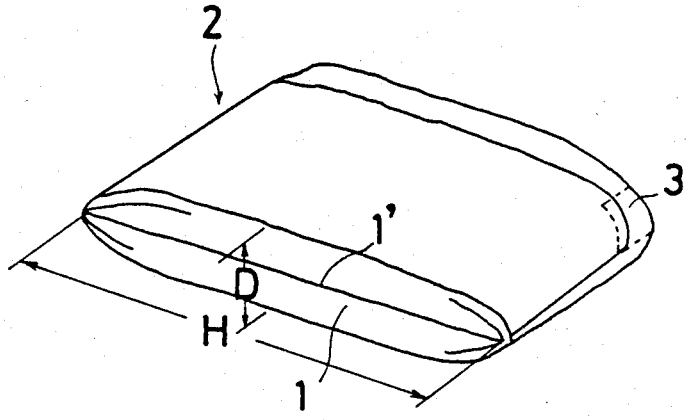
FIG. 2 is a perspective view of the packaging bag of FIG. 1, with a particulate material filled therein.

In FIG. 1, there is shown a side valve type packaging bag made of laminated layer kraft paper, and having pasted portions at upper and lower bottoms, gusset portions (1) at opposite sides, and a valve hole (3) at its upper left corner, while FIG. 2 shows a state where said bag is filled up with a particulate material and the valve hole (3) thereof is closed so as to be sealed by application of paste.

Figure 5:
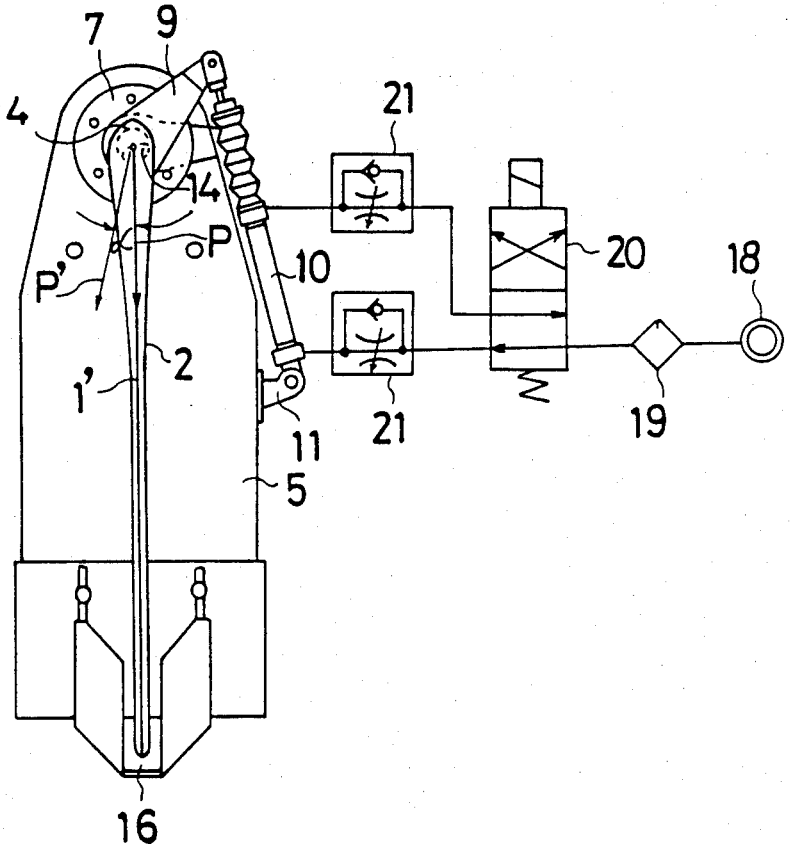
FIG. 5 is a front elevational view of the filling apparatus showing a state where the bag is mounted thereto.
Figure 3:
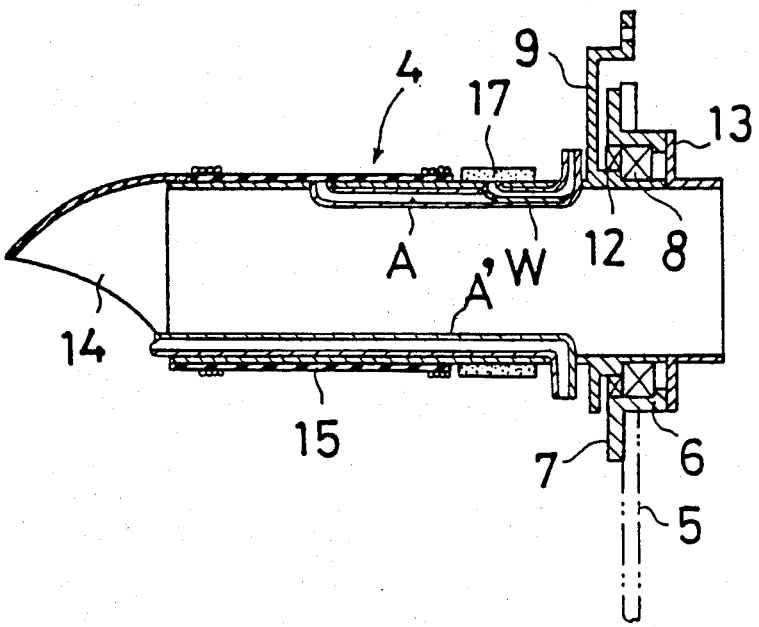
FIG. 3 is a side sectional view of a filling tube and a support portion thereof which constitute an essential portion of a filling apparatus according to one preferred embodiment of the present invention.
Figure 4:
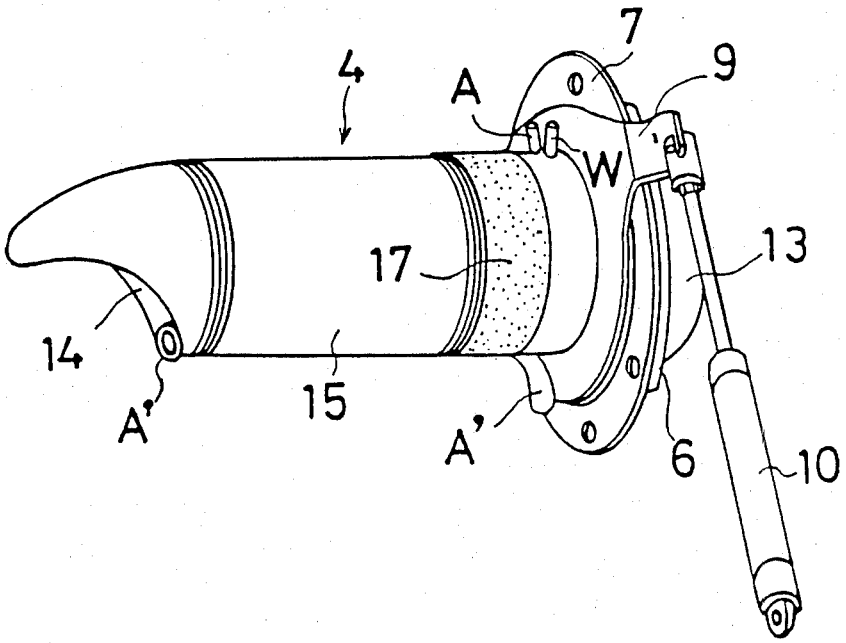
FIG. 4 is a perspective view of the portion of FIG. 3.

Meanwhile, in FIGS. 3, 4 and 5 illustrating essential portions of an apparatus for effecting the filling method according to the present invention, FIG. 3 shows a side sectional view of a filling tube and its support portion of the apparatus, FIG. 4 shows a perspective view of the above portions, and FIG. 5 is a front elevational view showing the state where the bag is attached to said portions.

The arrangement as shown in FIGS. 3 through 5 includes the filling tube (4) rotatably mounted in a cantilever fashion on a metering frame (5) of the filling apparatus through a flange portion (7) of a bearing case (6).

At a pipe portion to which an inner race of a ball bearing (8) accommodated in the bearing case (6) is fixed, there is provided a lever (9) integral therewith, and to the end portion of said lever (9), an operating rod of an air cylinder (10) is pivotally connected by a pin. The air cylinder (10) referred to above is of double-acting crevice type, and is also pivotally coupled to a support bracket (11) secured to the metering frame (5) by another pin. Accordingly, by the selective extension or retraction of the operating rod by the air cylinder (10), the filling tube (4) may be rotated about its axis through a predetermined range of angle. In an annular gap formed between the pipe portion integral with the lever (9) and the bearing case (6), a dust seal (12) is provided, while a cover (13) forming a part of the pipe portion is applied to the bearing case (6) so as to prevent the particulate material being filled or other foreign matters from entering the bearing case (6), and also to prevent lubricating grease from flowing outwardly. Although not particularly shown in FIG. 3, a feed-out pipe for the particulate material is coupled with the pipe portion integral with the cover (13) through a flexible joint so that the particulate material supplied from a particulate material hopper of the filling apparatus by a screw conveyor (not shown), through these pipe portions, is pushed out into the filling tube (4) together with compressed air. At the lower half end portion of the filling tube (4), there is provided a pouring port (14), while an expansion tube portion (15) formed by a rubber tube fixed at its opposite ends for covering is provided adjacent thereto so as to be expanded into an oval configuration by compressed air fed through a fine tube (A) for close adhesion to the inner peripheral face of the valve hole (3) of the bag (2), thereby to support the bag (2) together with a lower support plate (16) for the metering frame (5), and simultaneously, to serve as a sealing which prevents external scattering of the particulate material pushed out from the pouring port (14) of the filling tube (4) by the compressed air.

The fine tube (A) referred to above opens into the pouring port (14) and is intended for discharging air which is not completely discharged from the kraft paper itself during filling of the particulate material into the bag (2), while another fine tube (W) has for its object to intermittently feed a small amount of water to a re-wetting portion (17) made of a felt or sponge directed around a peripheral surface of the filling tube (4) between the expansion tube portion (15) and the lever (9) for keeping said re-wetting portion (17) properly wet at all times. Into the air cylinder (10), air for control purpose is fed from a compressed air source (18) through a lubricator (19), a direction changeover magnet valve (20) and further a flow rate control valve (21). It should be noted here that in the drawing, a reduction valve is omitted on the assumption that the operating air is adjusted to a predetermined pressure at the air source (18). It is also to be noted that the valve hole portion (3) of the valved packaging bag (2) is preliminarily applied with a bonding agent for perfect drying.

The bonding agent referred to above has such a property that upon wetting by known solvents such as water and others, i.e. active solutions, it is immediately dissolved to achieve a strong bondability, and for the kraft paper, a bonding agent which has a drying time lag period between the rewetting thereof and separation of the bag (2) from the filling tube (4), and which will not be affected by room temperatures, is selected for use, for example, from material high polymers such as casein, gum arabic, etc., or those mainly composed of synthetic high polymers such as polyvinyl alcohol, polyvinyl ether and the like.

Incidentally, the gusset portions of the bag (2) are stretched to a certain extent by suction cups and the like of the filling apparatus handling mechanism and the filling tube (4) is inserted into the valve hole (3) as shown in FIG. 5. Subsequently, when the compressed air is fed into the expansion tube portion (15) through the fine tube (A), said expansion tube portion (15) is caused to closely adhere to the inner peripheral surface of the valve hole portion (3) in the manner as described earlier so as to hold the bag (2) with the help of the lower support plate (16) of the metering frame (5).

In the above case, since the bag (2) is of the side valve type, the filling tube (4) is inserted into the valve hole portion (3) through deviation towards the left side in FIG. 5 with respect to the plane connecting the folding lines (1') for the gussets at the opposite sides, and owing to the fact that the operating rod of the air cylinder (10) is extended by the compressed air supplied into said air cylinder (10) through the direction change-over valve (20), the filling tube (4) is rotated in the counterclockwise direction as observed from the front side through the lever (9) connected to the operating cylinder, and thus, the particulate pouring axis (P) of its pouring port (14) has been positioned in the direction as shown in the drawing. In other words the packaging bag (2) is to be fixed at the valve hole portion (3) by the filling tube (4) held in the attitude as described above.

Simultaneously with the start of functioning when the particulate material is pushed out through the filling tube (4) by the compressed air, the direction change-over valve (20) is energized for changing over of the connecting positions thereof. Accordingly, since the passage of air to be fed into the air cylinder (10) is changed over, retraction of the operating rod begins. Following the above function, the lever (9) is rotated in the clockwise direction as viewed from the front side so as to rotate the filling tube (4), and accordingly, the particulate material pouring axis of the pouring port (14), i.e. the discharging direction (P) of the particulate material is similarly changed over in the clockwise direction. Since the bag (2) is fixed at its valve hole portion (3) to the filling tube (4) as stated previously, the bag (2) itself is also bent into a gentle S-shape.

Along with the functionings as described above effected by the filling tube (4) and the bag (2), the particulate material is gradually filled from the pouring port (14) of the filling tube (4) along the pouring axis (P) into the bag (2) by the action of the compressed air, while the excess air introduced into the bag together with the particulate material is discharged through the fine tube (A').

In the above case, since the filling of the particulate material into the bag (2) is effected through the pouring port (14) of the filling tube (4) along the rotating pouring axis (P) thereof, the particulate material is introduced into the bag (2) approximately uniformly without deviation of its level to one side within the bag (2), with the center of gravity of the particulate material being generally held in a central plane, and therefore, no moment that will twist the bag (2) is produced, and most of the weight is supported by the lower support plate (16), thus almost no load is applied to the valve hole portion (3) of the bag (2) and consequently, to the filling tube (4).

The particulate material filled in the bag (2) is automatically measured through the metering frame (5), and when the measured value thus obtained reaches a set value, the pouring of the particulate material is suspended, with simultaneous discharging of air forced into the expansion tube portion (15) through the fine tube (A') for contraction thereof. Subsequently, the lower support plate (16) supporting the bottom portion of the bag (2) is tilted downwards, and thus, the bag (2) filled with the particulate material falls downwardly, while being inclined forwards, as in FIG. 5, by its weight.

On the other hand, since the arrangement is so made that, upon insertion of the filling tube (4) into the valve hole portion (3) of the bag (2), the inner peripheral surface of said valve hole portion (3) is brought into contact, at least partly, with the re-wetting portion (17) which is kept wet by water at all times, and the bonding material applied thereto as described earlier is activated to achieve a strong bondability by the water of the re-wetting portion (17). Accordingly, when the bag (2) falls in the manner as described earlier, the particulate material accommodated in the bag (2) depresses the valve hole portion (3) so as to collapse it, whereby the valve hole portion (3) is depressed to be strongly bonded for sealing.

Incidentally, on the assumption that the thickness and height of the bag (2) filled with the predetermined amount (G kg) of particulate material and pasted at its valve hole portion (3) for sealing, is represented by D and H respectively, and the pouring axis of the pouring port (14) of the filling tube (4) during the filling is changed in its direction from the position (P) to the position (P'), the degree of an angle $\alpha$ defined by the two positions may be properly selected from the thickness D and the height H as referred to above. Thus, when a radius of rotation {i.e. length of the arm of the lever (9)} is determined subsequent to the determination of the angle $\alpha$, the required stroke (S) of the air cylinder (10) may be automatically determined. Meanwhile, with respect to the stroke velocity V of the air cylinder (10), the flow rate control valve (21) may be so adjusted as to achieve the relation $V=S\cdot(g/G)$, since the time required for only the filling of the bag (2) will be G/g second, on the supposition that the amount of delivery from the filling tube (4) is set at g kg/sec.

It should also be noted here that, instead of the arrangement in which the actuator such as the air cylinder (10), is attached to the lever (9) for the filling tube (4) so as to positively rotate the filling tube (4) as the filling proceeds in the manner as described earlier, to change over the discharging direction of the particulate material from the pouring port (14) from the direction towards P to the direction towards P', it may be so modified that, a spring or the like is connected with the lever (9) to rotate the filling tube (4) in the counterclockwise direction by the spring force thereof as viewed from the front side, with the filling tube (4) being adapted to be stopped by a stopper (not shown) at a position where the discharging direction of the particulate material from the pouring port (14) is aligned, with the direction towards P, and thereafter, the particulate material is discharged into the bag (2) so that the filling tube (4) is rotated in the clockwise direction against the spring force of the spring referred to earlier, by a torque acting from the position of gravity center of the particulate material filled in the bag (2) in the deviated manner, onto the expansion tube portion (15) through the valve hole portion (3) of said bag (2) so as to change over the discharging direction of the particulate material from said pouring port (14) towards the direction of P'. It is to be noted, however, that, for filling a particulate material with a low specific gravity, the actuator should preferably be employed for better filling.

As is clear from the foregoing description with respect to the construction and functions of the apparatus for effecting the method according to the present invention, with regard to the filling method and the apparatus for filling the particulate material into the valved packaging bags of the present invention, and for filling the particulate material into such valved packaging bags, especially, into the side valve type valved packaging bags, it is so arranged that the filling of the particulate material into the bag gradually proceeds while the pouring axis from the pouring port of the filling tube for the particulate material is being rotated through a proper angle range, and therefore, it becomes possible to effect the filling approximately uniformly in the bag in which the valve hole portion thereof is deviated to one side during setting to the apparatus, without any possibility of applying undue force to the bag and the filling tube in the course of filling. Accordingly, damages not only to the bags, but also to the filling tube have been completely eliminated so as to display a remarkable effect with respect to the bagging operations of particulate materials. It is needless to say that the present invention is not limited in its application to the foregoing embodiments alone, but may be readily applied to filling of particulate materials into various side valve type valved packaging bags irrespective of presence or absence of the gusset portions.

What is claimed is:

1. A method of filling a particulate material into a valved packaging bag having a central plane, which comprises the steps of inserting a filling tube in a direction parallel to the central plane of the bag into a valve hole of a side valve type valved packaging bag having a filling opening side face thereof, supplying particulate material into said bag through said filling tube, and rotating the filling tube about its axis during filling of the bag so that the direction in which the particulate material is introduced into the bag from the end of said filling tube moves through an angle with respect to the central plane toward one side of said bag.

2. Apparatus for filling a particulate material into a valved packaging bag having a central plane, which comprises bag support means for supporting a bag with its central plane in a generally vertical orientation, filling tube means including filling tube support means for supporting a filling tube vertically above the bag support means in a generally horizontal orientation, the filling tube means including a filling tube supported for rotation about its axis by the filling tube support means and terminating in a pouring port directed at an angle to the axis of the filling tube, and means for rotating the filling tube about its axis.

* * * * *